US008301382B2

(12) United States Patent
Herrera

(10) Patent No.: US 8,301,382 B2
(45) Date of Patent: Oct. 30, 2012

(54) CONTINUOUS GEOMECHANICALLY STABLE WELLBORE TRAJECTORIES

(75) Inventor: Adrian Enrique Rodriquez Herrera, Estado Nueva Esparta (VE)

(73) Assignees: Schlumberger Technology Corporation, Sugar Land, TX (US); Adrian Enrique Rodriquez Herrera, Estado Nueva Esparta (VE)

( * ) Notice: Subject to any disclaimer, the term of this patent is extended or adjusted under 35 U.S.C. 154(b) by 387 days.

(21) Appl. No.: 12/412,842

(22) Filed: Mar. 27, 2009

(65) Prior Publication Data

US 2010/0243328 A1 Sep. 30, 2010

(51) Int. Cl.
*G01V 11/00* (2006.01)
*G01B 5/30* (2006.01)
*G06G 7/48* (2006.01)

(52) U.S. Cl. ..... 702/11; 702/10; 702/13; 702/42; 703/10

(58) Field of Classification Search ..... 702/11, 702/10, 13, 42; 701/202; 703/10
See application file for complete search history.

(56) References Cited

U.S. PATENT DOCUMENTS

| | | | |
|---|---|---|---|
| 4,804,051 | A | 2/1989 | Ho |
| 5,113,953 | A | 5/1992 | Noble |
| 5,265,682 | A | 11/1993 | Russell et al. |
| 5,520,255 | A | 5/1996 | Barr et al. |
| 5,553,678 | A | 9/1996 | Barr et al. |
| 5,553,679 | A | 9/1996 | Thorp |
| 5,582,259 | A | 12/1996 | Barr |
| 5,603,385 | A | 2/1997 | Colebrook |
| 5,673,763 | A | 10/1997 | Thorp |
| 5,685,379 | A | 11/1997 | Barr et al. |
| 5,695,015 | A | 12/1997 | Barr et al. |

(Continued)

FOREIGN PATENT DOCUMENTS

| | | | |
|---|---|---|---|
| WO | 2009021010 | A2 | 2/2009 |

(Continued)

OTHER PUBLICATIONS

Mastin, L., Effect of Borehole Deviation on Breakout Orientations, Journal of Geophysical Research, 1988, vol. 93, No. B8, pp. 9187-9195.

(Continued)

*Primary Examiner* — Hal Wachsman
*Assistant Examiner* — Regis Betsch
(74) *Attorney, Agent, or Firm* — Jianguang Du; Hoffman Warnick LLC

(57) ABSTRACT

A continuous geomechanically stable trajectory in a subterranean formation is found by calculating at least one reachable stable position relative to a starting position based on geological data indicative of characteristics of the subterranean formation, and iteratively utilizing the calculated reachable stable position as a new starting position. The calculation may be constrained by a boundary including selected distance and direction relative to the starting position, and selected rate of angle change. Within the constraints of the boundary, the possible new trajectories considered may be discretized. The result of the calculations is a three dimensional tree which defines a stability volume. Pruning of at least some branches of the tree may be employed so that not all stable positions have the preselected number of branches, thereby helping to elongate the tree. Either or both of the tree and stability volume are used to select at least one trajectory. For example, the trajectory may be selected from sets of interconnected stable wellbore positions, or based on some other criteria constrained by the stability volume. The trajectory is then used as the basis for drilling a borehole.

28 Claims, 8 Drawing Sheets

U.S. PATENT DOCUMENTS

| | | | | |
|---|---|---|---|---|
| 5,706,905 | A | 1/1998 | Barr | |
| 5,778,992 | A | 7/1998 | Fuller | |
| 5,803,185 | A | 9/1998 | Barr et al. | |
| 5,971,085 | A | 10/1999 | Colebrook | |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 6,549,879 | B1 * | 4/2003 | Cullick et al. | 703/10 |
| 6,772,066 | B2 | 8/2004 | Cook | |
| 7,096,172 | B2 * | 8/2006 | Colvin et al. | 703/10 |
| 7,114,580 | B1 | 10/2006 | Balogh | |
| 7,251,561 | B2 * | 7/2007 | Dotan et al. | 701/207 |
| 2001/0052428 | A1 | 12/2001 | Larronde et al. | |
| 2002/0011359 | A1 | 1/2002 | Webb et al. | |
| 2002/0183922 | A1 * | 12/2002 | Tomasi et al. | 701/202 |
| 2004/0122640 | A1 * | 6/2004 | Dusterhoft | 703/10 |
| 2006/0151214 | A1 * | 7/2006 | Prange et al. | 175/45 |
| 2007/0062851 | A1 * | 3/2007 | Schulz et al. | 209/584 |
| 2007/0156330 | A1 * | 7/2007 | Goldberg et al. | 701/202 |
| 2008/0010006 | A1 * | 1/2008 | Schwarzmann | 701/202 |
| 2010/0125349 | A1 * | 5/2010 | Abasov et al. | 700/90 |
| 2010/0179797 | A1 * | 7/2010 | Cullick et al. | 703/10 |

FOREIGN PATENT DOCUMENTS

| | | | |
|---|---|---|---|
| WO | WO 2009/0332416 | * | 3/2009 |
| WO | 2010111630 | A3 | 9/2010 |

OTHER PUBLICATIONS

Gil, I. et al., Borehole Design: Stability Considerations, Society of Petroleum Engineers//International Society of Rock Mechanics Conference,Irving, Texas, Oct. 2002, SPE/ISRM 78182, pp. 1-7.

Smirnov, N.Y., et al., Process of Integrating Geomechanics with well design and drilling operation, American Association of Drilling Engineers 2003 National Technology Conference, Houston, Texas, Apr. 2003, AADE-03-NTCE-28, pp. 1-5.

Rodriguez Herrera, A. E. Geomechanical Constraints for Assisted Wellbore Trajectory Design—Stability Navigation Algorithms, 11th European Conference on the Mathematics of Oil Recovery, Berger, Norway, Sep. 2008, pp. 1-10.

PCT Application No. PCT/US2010/028882, International Search Report dated Oct. 4, 2010.

* cited by examiner

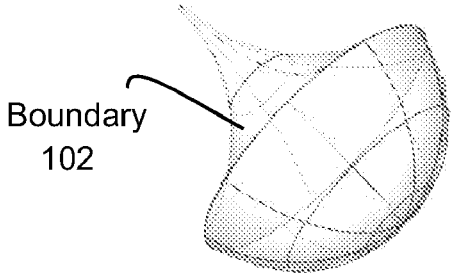
Figure 4a
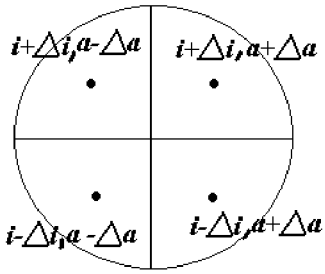
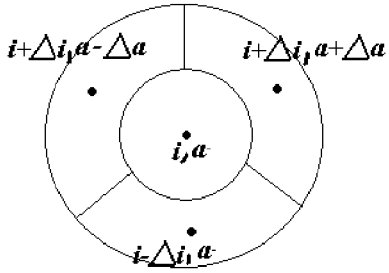
Figure 4b Figure 4c

CONTINUOUS GEOMECHANICALLY STABLE WELLBORE TRAJECTORIES

FIELD OF THE INVENTION

This invention is generally related to borehole trajectory selection, and more particularly to calculation and selection of continuous geomechanically stable wellbore trajectories.

BACKGROUND OF THE INVENTION

The integration of geomechanics and wellpath design is currently a subject of various research efforts. Generally, the proposals published to date are modified workflows which incorporate stability analysis within the overall process of determining well trajectory for a given situation. Such modified workflows attempt to reconcile the different, and sometimes contradictory, goals of achieving borehole stability and reaching one or more positions at different depths in a formation. Currently, the state of the art is a workflow that combines the two problems by executing a pre-processing step and a post-processing step.

The pre-processing step includes calculation of a subset of geometric conditions which satisfy user-defined stability criteria. The results are translated into corresponding wellbore positions, and may be presented to the engineer as colored polar plots indicative of stress distribution around a borehole for various combinations of inclination and azimuth. By iteratively modifying inclination and azimuth for sets of controllable and uncontrollable variables it is possible to produce an instability indicator based on selected failure criterion. This allows calculation of maximum and minimum values of any other variable to achieve stability, e.g., minimum rock strength to prevent shear failure. However, there is no nexus between positions, and wellpath selection is a function of individual manipulation and interpretation by the engineer.

The post-processing step is employed after the wellpath is selected by the engineer. In particular, based on an n-dimensional geomechanical model, post-processing generates a depth profile of drilling fluid density to prevent shear and tensile failures of the borehole walls. This data is employed to calculate a requisite drilling mud weight. Note that this does not improve the wellpath solution provided by the pre-processing step, but rather helps to compensate for deviation from an optimal wellpath solution by calculating drilling mud weight requirements to prevent failure of the least geomechanically stable positions.

One of the drawbacks of the two-step workflow described above is that solutions are heuristic and determined manually. For an n-layer geomechanical model, where for each layer a polar plot will be computed, a set of n suggested wellbore positions is associated with a corresponding depth. Given a wellhead at a starting point P1 and a target position P2, the engineer attempts to manually find a path P1-P2 which satisfies the set of pre-processed position suggestions at each depth. This process is relatively slow because it is manual. Further, the process is heuristic because the relative strengths of different potential trajectories may not be apparent to the engineer without some analysis, i.e., the engineer cannot pick the best trajectory out of the data, but rather picks various potential trajectories for comparison. As a result, the selected wellpath may be far from optimal.

SUMMARY OF THE INVENTION

In accordance with an embodiment of the invention, a method for calculation of a continuous geomechanically stable trajectory in a subterranean formation comprises the steps of: iteratively calculating at least one reachable stable position relative to a starting position by employing geological data indicative of characteristics of the subterranean formation and utilizing the calculated reachable stable position as a new starting position; and outputting results of the iterative calculations in tangible form.

In accordance with an embodiment of the invention, a computer program product comprises a computer usable medium having a computer readable program code embodied therein, said computer readable program code adapted to be executed to implement the method described above.

In accordance with another embodiment of the invention, apparatus for calculation of a continuous geomechanically stable trajectory in a subterranean formation comprises: a machine that iteratively calculates at least one reachable stable position relative to a starting position by employing geological data indicative of characteristics of the subterranean formation and utilizing the calculated reachable stable position as a new starting position; and an interface that outputs results of the iterative calculations in tangible form.

Relative to trajectory calculation workflows described in the Background, the invention advantageously automates trajectory calculation, either partially or completely. Consequently, suitable results tend to be less time consuming to produce and less prone to error. One practical implication is that the selected trajectory is more likely to be continuously geomechanically stable.

These and other advantages of the invention will be more apparent from the detailed description and the drawings.

BRIEF DESCRIPTION OF THE FIGURES

FIGS. 4*a* through 4*c* illustrate discretization of possible new trajectories within the boundary of FIG. 3.

DETAILED DESCRIPTION

Figure 1:
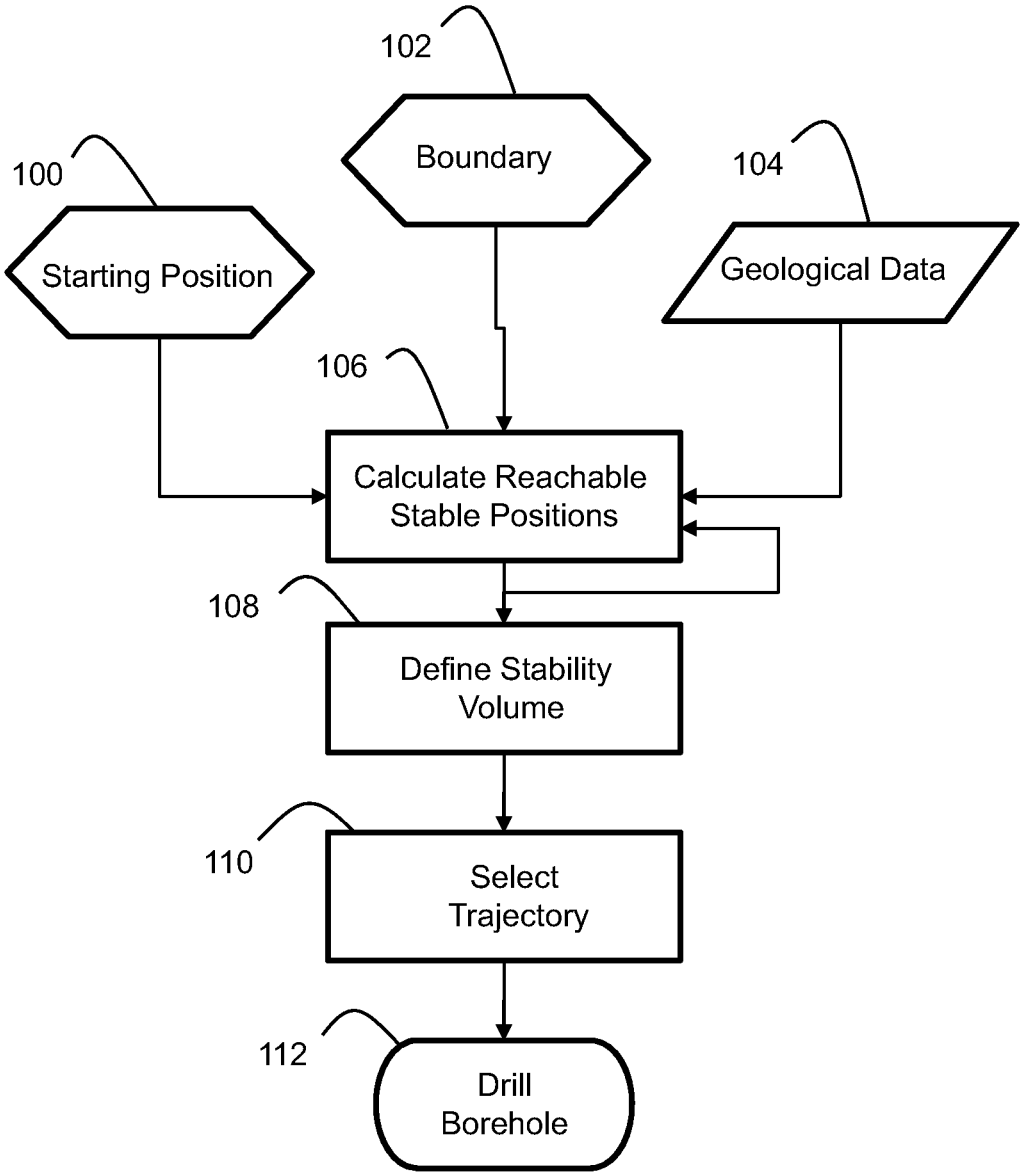
FIG. 1 illustrates general steps of a method for selecting and drilling a borehole having a continuous geomechanically stable trajectory.

FIG. 1 illustrates general steps of a method for selecting and drilling a borehole having a continuous geomechanically stable trajectory. Some or all of the steps may be implemented by a computer, or with the assistance of a computer. As such, at least some of the steps may be embodied in a computer program product stored on a computer-readable medium.

Referring now to FIGS. 1 and 2*a* through 2*c*, a starting position 100, boundary volume 102 and geological data 104 are provided as initial inputs. Based on those inputs, a stability navigation algorithm is employed to compute a set of reachable stable positions relative to the starting position as indicated by step 106. In particular, the reachable stable positions are constrained by both the boundary volume 102 and a geological model defined by the extent of available geological data, and stability is determined as a function of the geological data. This step 106 may be repeated over multiple iterations by using the reachable stable positions from one iteration as new starting positions in a subsequent iteration, resulting in a three dimensional directed acyclic graph of stable positions, i.e., a tree, where each vertex or node represents a stable wellbore position linked to a stable parent node from which it was computed, and to one or more stable child nodes. The tree defines a three dimensional stability field, i.e., a stability volume, calculated in step 108. Either or both of the tree and stability volume may be employed to select one or more continuous geomechanically stable trajectories as indicated in step 110, which are used to drill corresponding boreholes as indicated in step 112. These general steps will be described in more detail below.

Figure 3:
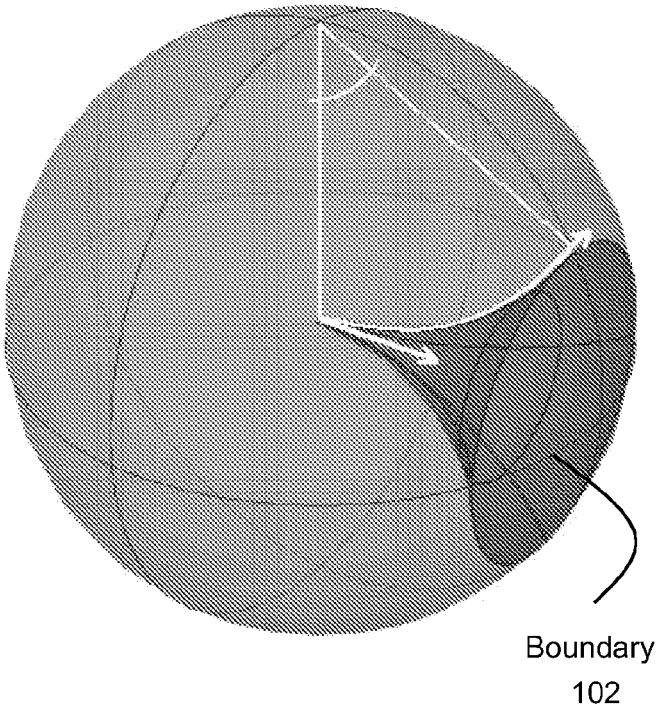
FIG. 3 illustrates the initial boundary volume of FIG. 1.

Referring to FIGS. 1 and 3, the number of possible new positions relative to an initial position, even when limited to a certain distance, is infinite and defines the surface of a sphere. Consequently, the search performed by the stability navigation algorithm is limited by the boundary 102. The boundary volume may be defined by various factors including but not limited to the limitations of the drilling equipment. For example, the rate of angle change, i.e., curvature, is a fundamental operational limitation in drilling engineering known as "dogleg severity" or DLS. The stress fatigue in drilling pipe, casing wear and casing design load are functions of DLS magnitude. In one embodiment the initial boundary volume is defined by a selected maximum DLS for a selected direction and selected range from a starting position. The boundary volume may also be limited by a predefined range and distance relative to the starting position. An example of the resulting boundary volume is depicted in FIG. 3. However, other boundary factors might alternatively be selected.

Referring to FIGS. 4*a* through 4*c*, within the initial boundary volume 102 the number of possible new search directions is still infinite. Consequently, the search performed by the stability navigation algorithm is discretized into b number of possible new trajectories. In other words, a set of possible trajectories is selected from the infinite number of available possible trajectories, and subjected to evaluation. For example, given an initial stable point P1(x, y, z, i, a) and a value for b equal to 4, the initial inclination i and azimuth a are modified in four different ways represented by a uniform search range discretization. Setting a viewing direction parallel to the unit vector formed by the initial i-a values, a reference coordinate system with an azimuth horizontal axis and an inclination vertical axis can be established. Each of the uniform subdivisions of the inclination-azimuth plane obtains a characteristic i-a combination that is used to calculate a new position in space using a "minimum curvature" function. Each of the four new derived positions in space intersect set rock mechanical properties and stress conditions inside the 3-dimensional geomechanical model. Using the characteristic i-a combination of each new position as the geometric conditions, the far-field principal stresses of the geomechanical model are converted into stresses around the wellbore, i.e., hoop stresses, using a poro-elastic analytical solution. This is used to calculate the principal stresses at each point around the circumference of the borehole. Under the Morh-Coulomb failure criterion, if any magnitude of shear or tensile failure is observed beyond a selected range, then the new position is tagged as unstable and discarded as a possible path. If not, the new position is tagged as a stable point. As already described, the tagged stable points serve as new initial positions in subsequent iterations.

Figure 5:
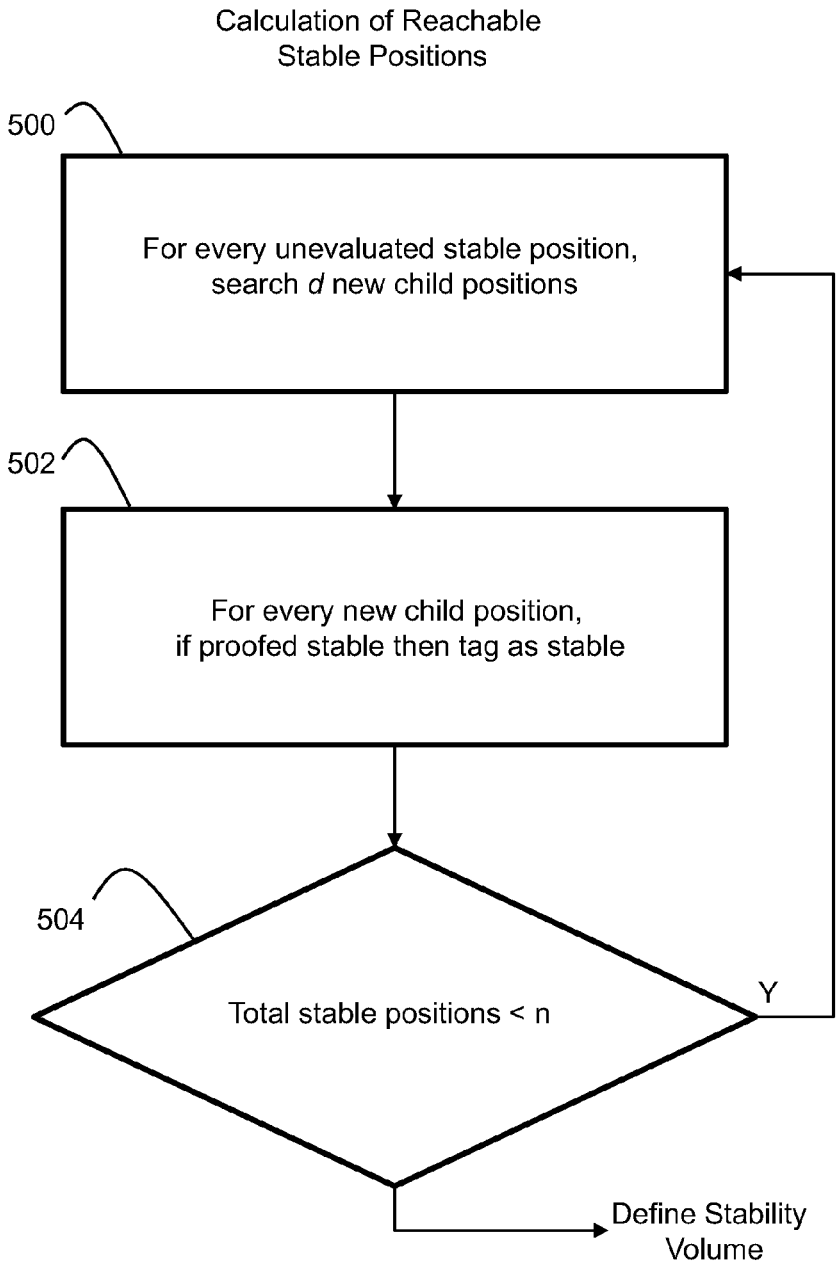
FIG. 5 illustrates the step of computing reachable stable positions in greater detail.

FIG. 5 illustrates the step (106, FIG. 1) of computing reachable stable positions in greater detail. Given a starting position x, y, z in a system of Cartesian coordinates for a n-dimensional geomechanical model with a correspondent initial inclination and azimuth, the stability navigation algorithm is employed to compute a set of geomechanically stable positions reachable from x, y, z within the predefined boundary volume. More particularly, within the constraints of the boundary volume the stability navigation algorithm recursively searches the discretized potential new stable wellbore positions relative to previously computed stable wellbore positions, beginning from the starting position P1. In a first step 500, for every unevaluated stable parent position, the algorithm searches d new potential child positions. For every new child position, if the position is stable it is tagged as stable as indicated by step 502. As indicated in step 504, the process is repeated while the total number of stable child positions is less than n.

Figure 6A:
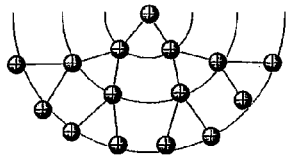
FIGS. 6*a* through 6*c* illustrate pruning for tree elongation.
Figure 6B:
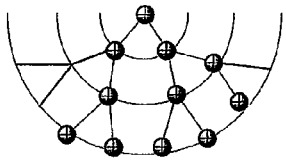
Figure 6C:
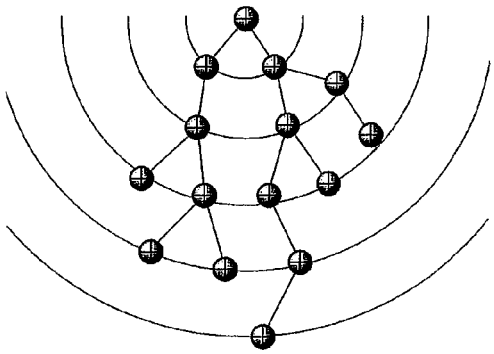

Referring to FIGS. 6*a* through 6*c*, pruning may be employed to facilitate elongation of the tree. Because every node will expand to a maximum of b children, a stability field is a b-ary tree where b is the "branching factor." For the case where every node expands to b number of new children, i.e., where every new position is stable, a breadth-first construction of a stability field would have the following number of nodes:

$$1+b+b^2+b^3+\ldots+b\hat{}(d-1)+b\hat{}d$$

where b=branching factor, and d=graph depth. This would asymptotically lead to a Θ (b^d) space complexity. It may therefore be desirable to proportion the maximum number of nodes. If the total number of nodes n is approximately equal to b^d, then the average depth d of the constructed graph would be given by log b n. Each depth increase from any node of the tree is a logical abstraction of a distance increase that has resulted from the stability navigation process, making it possible to assume that the average length of a stability field, or Lv, will be:

$$Lv=L \log bn$$

where n=total nodes, L=average course length, and b=branching factor. Mathematically, an increase in b produces a non-linear decay in Lv due to combinatorial explosion trends intrinsic in high branching factors. For a finite number of nodes this may significantly reduce the length of the state-space tree. A pruning technique is therefore employed so that not all nodes are expanded to b number of children. If the state-space tree is pruned at a given node N, the number of nodes of the subtree rooted at N is added to it at the leaf nodes in level-order while the maximum number of nodes is unattained. This pruning process advantageously has an elongation effect on the tree and associated stability field, and since b has a physical relation to the amount of new search directions of the stability navigation (inclination-azimuth plane discretization), it is possible to increase search directions without compromising the length of the stability field. This increment in search direction increases the stable-point density of the resulting volume, elevating the degree of certainty of any interpretable wellpath to be designed inside it. This branching factor-depth balance (b-d balance) is achieved with proper geomechanical constraints to prevent complete node expansions, meaning that the average effective branching factor b' is lower than b. One implementation of a stability navigation algorithm is characterized by b'<b, simultaneously achieving b-d balance and causing the expansion of only the most stable trajectories.

Exemplary pseudo-code for the stability navigation algorithm is as follows:

```
Number of stable points = 1
Searching
While Searching {
    n=Number of stable points
    Retrieve current wellbore position (n)
    For m=1,2,3 ... Branching factor {
        Compute new wellbore position (m)
        Find model properties from intersected cell
        Compute wellbore stability analysis
        If wellbore conditions are stable {
            Increase in 1 the number of stable points
            If number of stable points > Max number of nodes {
            Not searching
            }
        }
    }
}
```

It should be noted that the various constraints and variables of the stability navigation algorithm described above need not be held constant over the entire calculation. Although the constraints and variables are the basis of b-d balance, it is sometimes possible to enhance stability volume effectiveness relative to drilling strategy by relaxing or otherwise modifying the constraints and variables. In other words, adjustments may be employed to adjust calculation of the geometry of the stability volume to better suit expected or desired trajectory characteristics.

Figure 2A:
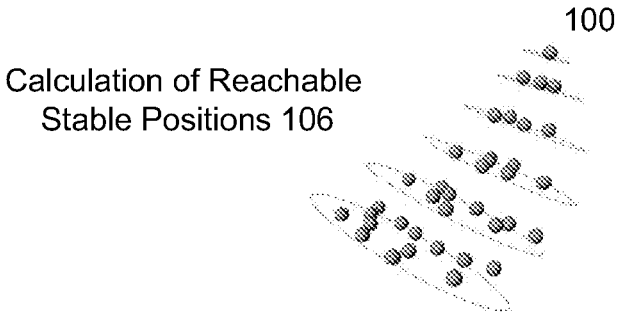
FIG. 2 graphically depicts exemplary results of the steps of the method of FIG. 1.
Figure 2B:
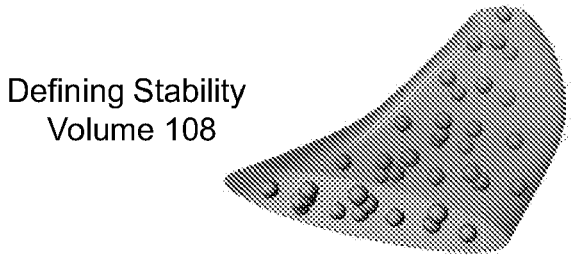
Figure 2C:
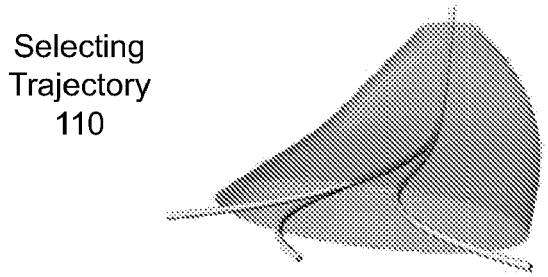
Figure 7:
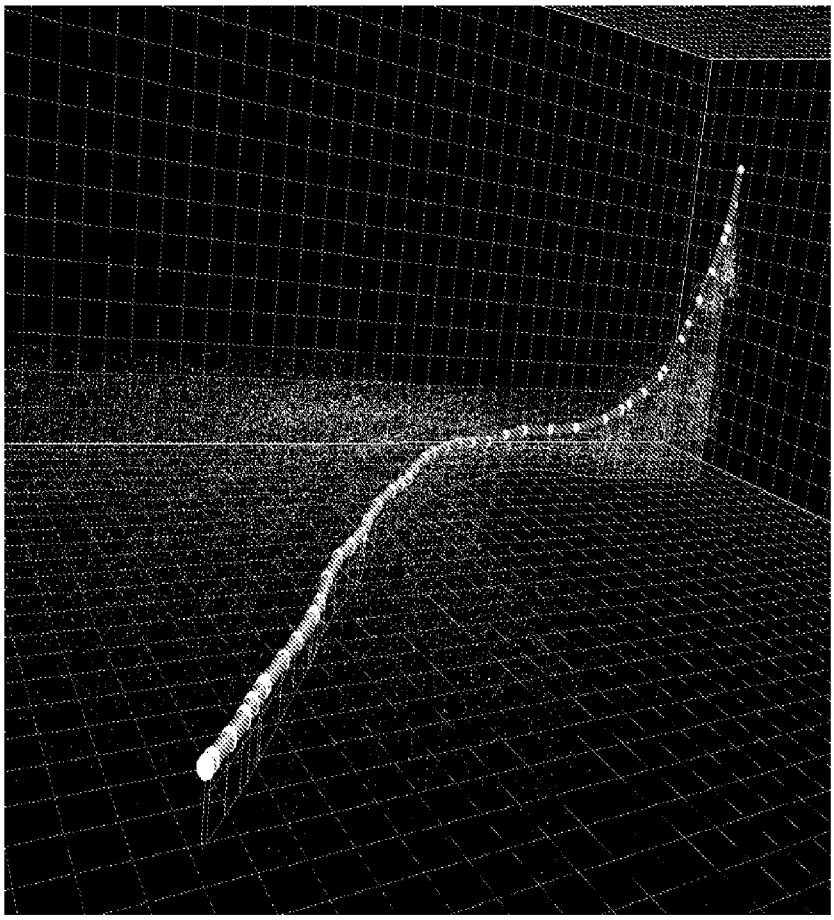
FIG. 7 illustrates trajectory selection.

Referring to FIGS. 2*b*, 2*c* and 7, the resulting set of all stable points exposed by the stability navigation algorithm, including starting point P1, is used to define the stability volume. Each stable point in space can be represented by its Cartesian position and a unit vector indicative of inclination and azimuth. Consequently, the stability volume can be represented as a discrete vector field where various pathlines represent potentially viable borehole trajectories. In one embodiment the selected trajectory is a bound solution comprising a set of interconnected stable wellbore positions from the tree which explicitly describe a continuous implicitly stable trajectory. The trajectory may be selected by comparing multiple candidates based on various factors including but not limited to average stability, minimum stability, length, and proximity to one or more positions at various depths. However, any borehole within the spatial bounds of the stability volume has an implicitly stable trajectory. Therefore, in another embodiment the trajectory is selected to satisfy one or more user-defined conditions within the spatial bounds of the stability volume without regard to the tree. In another alternative embodiment the selected trajectory is comprised of at least one set of interconnected stable wellbore positions as defined by the tree and one or more lengths selected from within the stability volume without necessarily traversing points of the tree. This hybrid technique may be useful where interconnected sets of tree positions do not traverse positions of interest or a continuous path from a starting position to a target position.

The final selected trajectory or trajectories is used as the basis for drilling boreholes. For example, equipment used to calculate the trajectories may be placed in communication with drilling equipment in order to cause each borehole to be drilled along a corresponding selected trajectory. Such communication could be in the form of signals or data stored on a physical medium.

Figure 8:
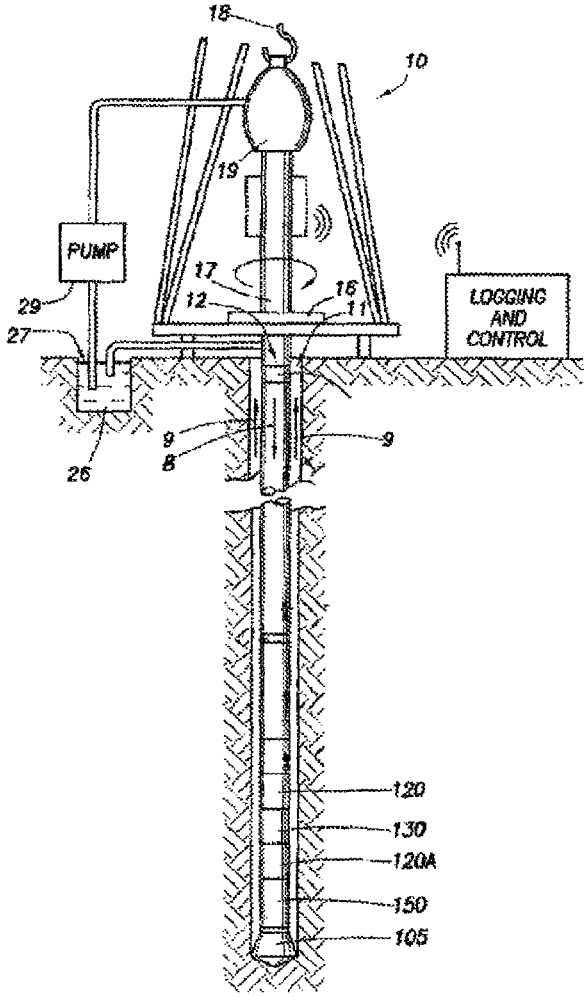
FIG. 8 illustrates a wellsite system in which the present invention can be employed.

FIG. 8 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter. The desired trajectory is achieved by drilling under control of the logging and control unit, which may receive data from another device or calculate the trajectory as described above.

A drill string 12 is suspended within the borehole 11 and has a bottom hole assembly which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly of the illustrated embodiment a logging-while-drilling (LWD) module 120, a measuring-while-drilling (MWD) module 130, a roto-steerable system and motor 150, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module may includes pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module may include one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem is provided. Directional drilling is the intentional deviation of the wellbore from the path it would naturally take. In other words, directional drilling is the steering of the drill string so that it travels in a desired direction. Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course. A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottom hole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference. In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut sideways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. A method for calculation of a continuous geomechanically stable trajectory in a subterranean formation comprising the steps of:

(i) providing a starting position;

(ii) calculating a number of reachable positions by drilling relative to the starting position wherein the number of reachable positions by drilling is 2 or greater and each reachable position by drilling is a first distance from the starting position using a computer;

(iii) determining hoop stresses around a circumference of a borehole at each reachable position by drilling from a geomechanical model of the subterranean formation using a poro-elastic analytic solution based on an inclination-azimuth plane of the borehole and principal stresses from the geomechanical model at each reachable position using a computer;

(iv) selecting a set of stable positions from the number of reachable positions by drilling by determining whether all the hoop stresses around the circumference of the borehole at each reachable position by drilling have a magnitude of shear or tensile failure less than a predetermined magnitude using a Mohr-Coulomb failure criterion using the computer;

(v) repeating steps (ii), (iii) and (iv) for each stable positions wherein each stable position serves as a starting position until a final position is reached using the computer; and outputting results of each of steps (i), (ii), (iii) and (iv) in tangible form.

2. The method of claim 1 wherein steps (ii), (iii) and (iv) are performed within a boundary.

3. The method of claim 2 including defining an initial boundary volume by a distance from the starting position and rate angle of change.

4. The method of claim 2 including discretizing possible new trajectories within the boundary.

5. The method of claim 1 wherein the sets of stable positions define a tree, and further comprising limiting branching at each stable position to a preselected number.

6. The method of claim 5 including pruning at least some branches of the tree so that not all stable positions have the preselected number of branches.

7. The method of claim 1 further comprising selecting at least one trajectory from sets of stable positions.

8. The method of claim 5 including employing the tree to define a stability volume.

9. The method of claim 8 including selecting at least one trajectory within the stability volume.

10. A computer program product, comprising a non-transitory computer readable medium having a computer readable program code embodied therein, said computer readable program code containing instructions for causing a computer processor to:

calculate a number of reachable position by drilling relative to a starting position wherein the number of reachable positions by drilling is 2 or greater and each reachable position by drilling is a first distance from the starting position;

determine hoop stresses around a circumference of a borehole at each reachable position by drilling from a geomechanical model of the subterranean formation using a poro-elastic solution based on an inclination-azimuth plane of the borehole and principal stresses from the geomechanical model at each reachable position;

select a set of stable positions from the reachable positions by drilling by determining whether all the hoop stresses around the circumference of the borehole at each reachable position by drilling have a magnitude of shear or tensile failure less than a predetermined magnitude using a Mohr-Coulomb failure criterion;

repeat the calculate, determine and select instructions for each of the stable positions wherein each stable position is a new starting position until a final position is reached; and outputting results of the iterative calculate, determine and select instructions in tangible form.

11. The computer program product of claim 10 wherein the calculate, determine and select instructions are performed within a boundary.

12. The computer program product of claim 11 including defining an initial boundary volume by a distance from the starting position and a rate angle of change.

13. The computer program product of claim 11 including discretizing possible new trajectories within the boundary.

14. The computer program product of claim 10 wherein all the calculated stable positions define a tree, and comprising limiting branching at each stable position to a preselected number.

15. The computer program product of claim 14 including pruning at least some branches of the tree so that not all stable positions have the preselected number of branches.

16. The computer program product of claim 10 further comprising selecting at least one trajectory from sets of stable positions.

17. The computer program product of claim 14 including employing the tree to define a stability volume.

18. The computer program product of claim 17 including selecting at least one trajectory within the stability volume.

19. Apparatus for calculation of a continuous geomechanically stable trajectory in a subterranean formation comprising:

a machine that calculates a number of reachable positions by drilling relative to a starting position wherein the number of reachable positions by drilling is 2 or greater and each reachable position by drilling is a first distance from the starting position;

determining hoop stresses around a circumference of a borehole at each reachable position by drilling from a geomechanical model of the subterranean formation using a poro-elastic analytic solution based on an inclination-azimuth plane of the borehole and principal stresses from the geomechanical model at each reachable position;

selecting a set of stable positions from the reachable positions by drilling by determining whether all the hoop stresses around the circumference of the borehole at each reachable position by drilling have a magnitude of shear or tensile failure less than a predetermined magnitude using a Mohr-Coulomb failure criterion;

repeating the calculating, determining and selecting for each of the stable positions wherein each stable position is a starting position until a final position is reached; and an interface that outputs results of the iterative calculating, determining and selecting elements in tangible form.

20. The apparatus of claim 19 wherein the calculating, determining and selecting elements are performed within a boundary.

21. The apparatus of claim 20 wherein an initial boundary volume is characterized by a distance from the starting position and a rate angle of change.

22. The apparatus of claim 20 wherein the machine discretizes possible new trajectories within the boundary.

23. The apparatus of claim 19 wherein all the sets of stable positions define a tree, and wherein the machine limits branching at each stable position to a preselected number.

24. The apparatus of claim 23 wherein the machine prunes at least some branches of the tree so that not all stable positions have the preselected number of branches.

25. The apparatus of claim 19 wherein the machine selects at least one trajectory from sets of stable positions.

26. The apparatus of claim 23 wherein the machine employs the tree to define a stability volume.

27. The apparatus of claim 26 wherein the machine selects at least one trajectory within the stability volume.

28. A method of drilling a borehole in a subterranean formation comprising the steps of:

calculating a number of reachable positions by drilling relative to a starting position wherein the number of reachable positions by drilling is 2 or greater;

determining hoop stresses around a circumference of a borehole at each reachable position by drilling from a geomechanical model of the subterranean formation using a poro-elastic analytic solution based on an inclination-azimuth plane of the borehole and principal stresses from the geomechanical model at each reachable position;

selecting a set of stable positions from the reachable positions by drilling by determining whether all the hoop stresses around the circumference of the borehole at each reachable position by drilling have a magnitude of shear or tensile failure less than a predetermined magnitude using a Mohr-Coulomb failure criterion;

repeating the calculating, determining and selecting steps for each stable position wherein each stable position is a starting position until a final position is reached;

selecting at least one trajectory from the from the sets of stable positions; and employing a representation of the at least one selected trajectory to drill at least one borehole in the formation.

* * * * *